US006811380B2

(12) United States Patent
Kim

(10) Patent No.: US 6,811,380 B2
(45) Date of Patent: Nov. 2, 2004

(54) APPARATUS AND METHOD FOR CONTROLLING LINEAR COMPRESSOR

(75) Inventor: Tae-Duk Kim, Yongin (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 71 days.

(21) Appl. No.: 10/238,613

(22) Filed: Sep. 11, 2002

(65) Prior Publication Data

US 2003/0161734 A1 Aug. 28, 2003

(30) Foreign Application Priority Data

Feb. 28, 2002 (KR) ..... 2002-11025

(51) Int. Cl.[7] ..... F04B 49/06; F04B 17/04

(52) U.S. Cl. ..... 417/44.1; 417/44.11; 417/274; 417/417

(58) Field of Search ..... 417/44.1, 45, 44.11, 417/415, 416, 417, 212, 274; 62/6

(56) References Cited

U.S. PATENT DOCUMENTS 5,342,176 A * 8/1994 Redlich ..... 417/212
5,980,211 A * 11/1999 Tojo et al. ..... 417/45
6,176,683 B1 * 1/2001 Yang ..... 417/44.1
6,289,680 B1 * 9/2001 Oh et al. ..... 62/6
6,398,523 B1 6/2002 Hur et al. ..... 417/417
6,536,326 B2 * 3/2003 Unger et al. ..... 91/361

* cited by examiner

*Primary Examiner*—Charles G. Freay
(74) *Attorney, Agent, or Firm*—Staas & Halsey LLP

(57) ABSTRACT

An apparatus and method of controlling a linear compressor. The apparatus includes a current detection unit to detect current, a control unit to determine whether a collision between a piston and a valve occurs, and controlling a stroke of the linear compressor, and a compressor drive unit to perform adjustment of the stroke of the linear compressor. The method includes presetting a maximum stroke and a collision point according to a load, selectively increasing and reducing a stroke of the linear compressor according to a variation in the load, and controlling the stroke.

16 Claims, 7 Drawing Sheets

APPARATUS AND METHOD FOR CONTROLLING LINEAR COMPRESSOR

BACKGROUND OF THE INVENTION

1. Field of the Invention

The present invention relates generally to an apparatus and method of controlling a linear compressor, and more particularly to an apparatus and method of controlling a linear compressor, which is capable of preventing collisions between the piston and valve of the linear compressor, thereby improving the operational efficiency of the linear compressor.

2. Description of the Prior Art

As depicted in FIG. 1, a linear compressor 1 is comprised of a drive unit 2, a resonance spring 3, a displacement restricting unit 4, a valve 5, a cylinder head 6, a piston 7 and a cylinder block 8.

A conventional apparatus to control the operation of a linear compressor is described below.

Referring to FIG. 2, the conventional control apparatus is comprised of a core 10, first and second coils 12 and 13, a signal processing unit 20 and a microcomputer 30. The core 10 is made of a magnetic substance and moved in conjunction with a part (that is, a piston) whose position is desired to be detected, the first and second coils 12 and 13 are symmetrically wound around the core 10, and the signal processing unit 20 detects and outputs variations in position of the core 10 using voltages induced to the first and second coils 12 and 13.

The signal processing unit 20 is comprised of a first full-wave rectification unit 21, a second full-wave rectification unit 22, a differential amplification unit 23, a filter unit 24, and a peak detection unit 25. The first full-wave rectification unit 21 full-wave rectifies the voltage induced to the first coil 12, the second full-wave rectification unit 22 full-wave rectifies the voltage induced to the second coil 13, the differential amplification unit 23 amplifies a difference between the voltages full-wave rectified by the first and second full-wave rectification units 21 and 22, the filter unit 24 eliminates a high-frequency component from a signal outputted from the differential amplification unit 23, and the peak detection unit 25 detects the maximum and minimum values of a signal outputted from the filter unit 24, and transmits the detected values to a microcomputer 30.

The operation of the conventional linear compressor is described below.

If the position of the core 10 is varied by a variation in position of a part (for example, the piston) whose position is desired to be detected while alternating current (AC), having a frequency of several KHz, is applied to the first and second coils 12 and 13 from the outside, voltages in proportion to the variation in position of the core 10 are induced to the first and second coils 12 and 13. The voltages induced to the first and second coils 12 and 13 are full-wave rectified by the first and second full-wave rectification units 21 and 22, and the full-wave rectified voltages are inputted to input terminals of the differential amplification unit 23. The differential amplification unit 23 amplifies a difference between the voltages full-wave rectified by the first and second full-wave rectification units 21 and 22, and outputs the amplified difference to the filter unit 24. The filter unit 24 eliminates a high-frequency component from the signal outputted from the differential amplification unit 23, and outputs the filtered signal to the peak detection unit 25. The peak detection unit 25 full-wave rectifies the signal outputted from the filter unit 24, and outputs the rectified signal to the microcomputer 30. The microcomputer 30 controls the stroke of the linear compressor 1 according to the signal rectified by and outputted from the filter unit.

The conventional linear compressor control apparatus controls only a stroke detected by a sensor, etc., so the stroke of the linear compressor can be controlled to be constant. However, in the linear compressor the center position of whose piston is varied according to load, a top clearance cannot be kept constant with respect to the top dead center of the piston. As a result, there occurs a problem that the piston of the linear compressor is brought into collision with the valve of the linear compressor.

SUMMARY OF THE INVENTION

Accordingly, it is an object of the present invention to provide an apparatus and method of controlling a linear compressor, which is capable of controlling a top clearance for the top dead center of the piston of the linear compressor, thus preventing the collision between the piston and valve of the linear compressor and improving the operational efficiency of the linear compressor.

Additional objects and advantages of the invention will be set forth in part in the description which follows and, in part, will be obvious from the description, or may be learned by practice of the invention.

The foregoing and other objects of the present invention are achieved by providing an apparatus to control a linear compressor, comprising: a current detection unit to detect current supplied to the linear compressor; a control unit to determine whether a collision between a piston and a valve of the linear compressor occurs by using an output signal from the current detection unit, and controlling a stroke of the linear compressor if the collision occurs; and a compressor drive unit to perform adjustment of the stroke of the linear compressor in response to control of the control unit.

In addition, the present invention provides a method of controlling a linear compressor, comprising: presetting a maximum stroke and a collision point according to a load; selectively increasing and reducing a stroke of the linear compressor according to a variation in the load; and controlling the stroke according to a variation in current supplied to the linear compressor.

BRIEF DESCRIPTION OF THE DRAWINGS

These and other objects and advantages of the invention will become apparent and more readily appreciated from the following description of the embodiments, taken in conjunction with the accompanying drawings of which.

DESCRIPTION OF THE PREFERRED EMBODIMENTS

Figure 1:
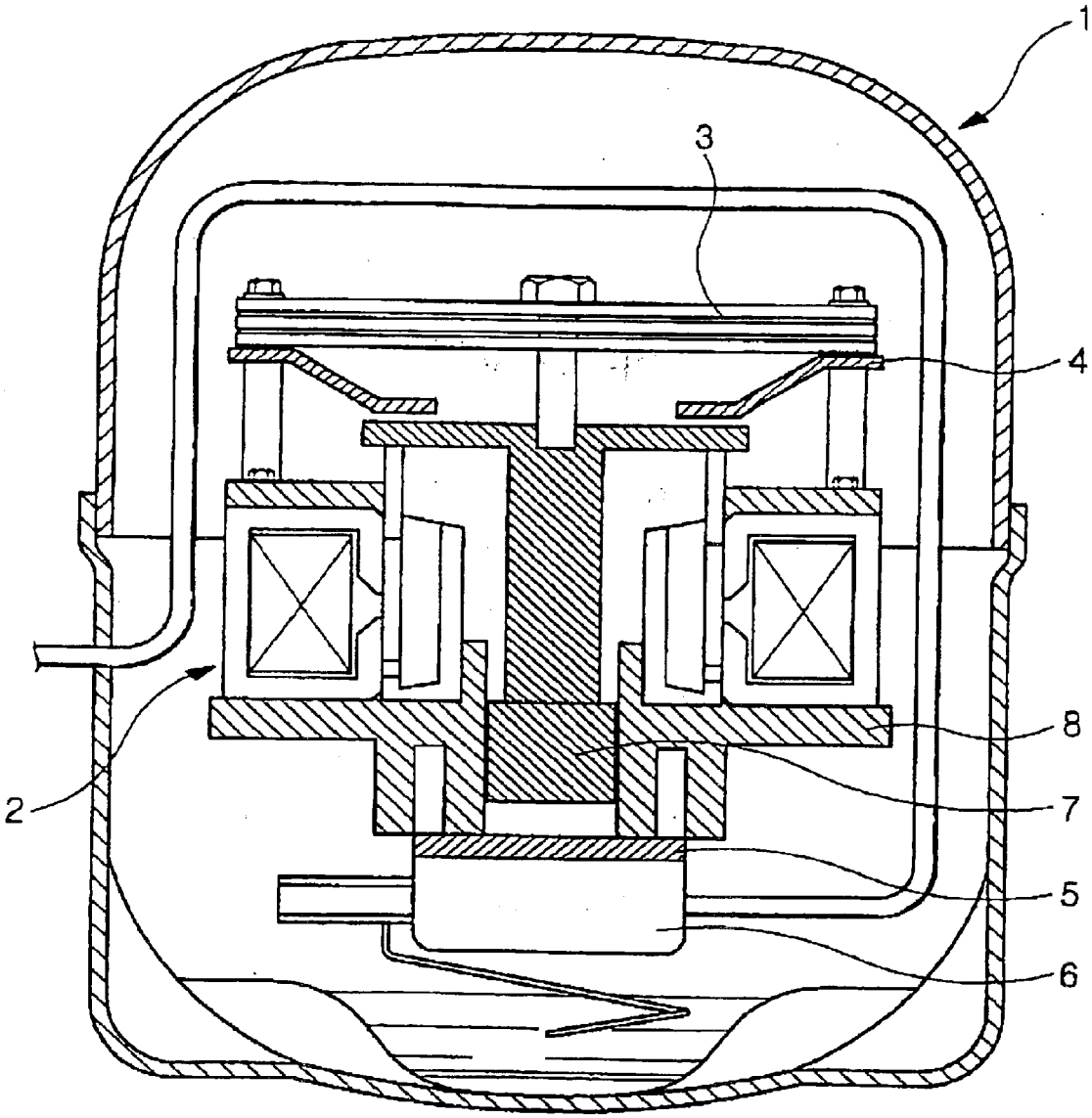
FIG. 1 (PRIOR ART)
FIG. 1 is a longitudinal section of a conventional linear compressor.
Figure 2:
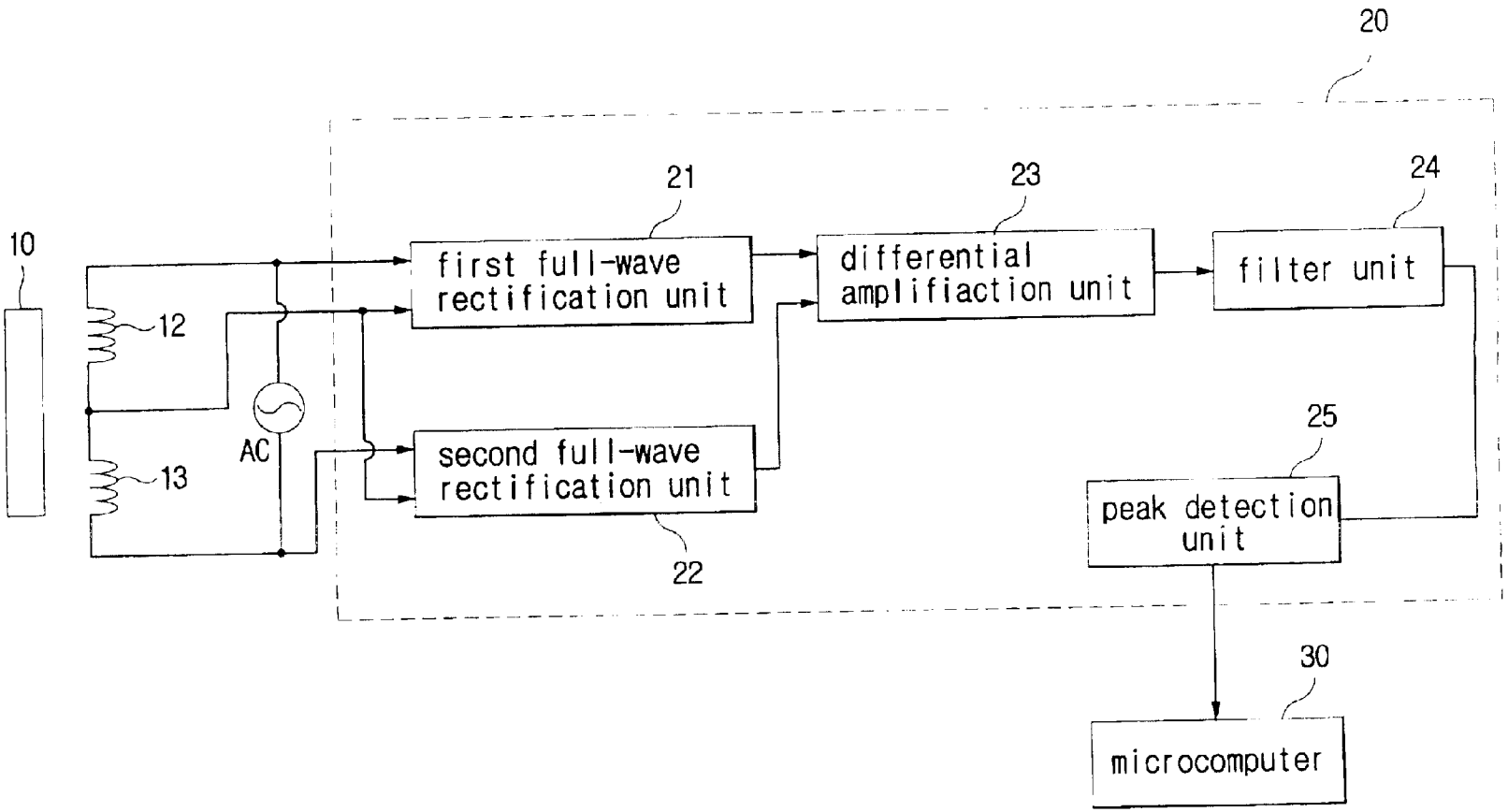
FIG. 2 (PRIOR ART)
FIG. 2 is a block diagram of a conventional apparatus to control the linear compressor of FIG. 1.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 3:
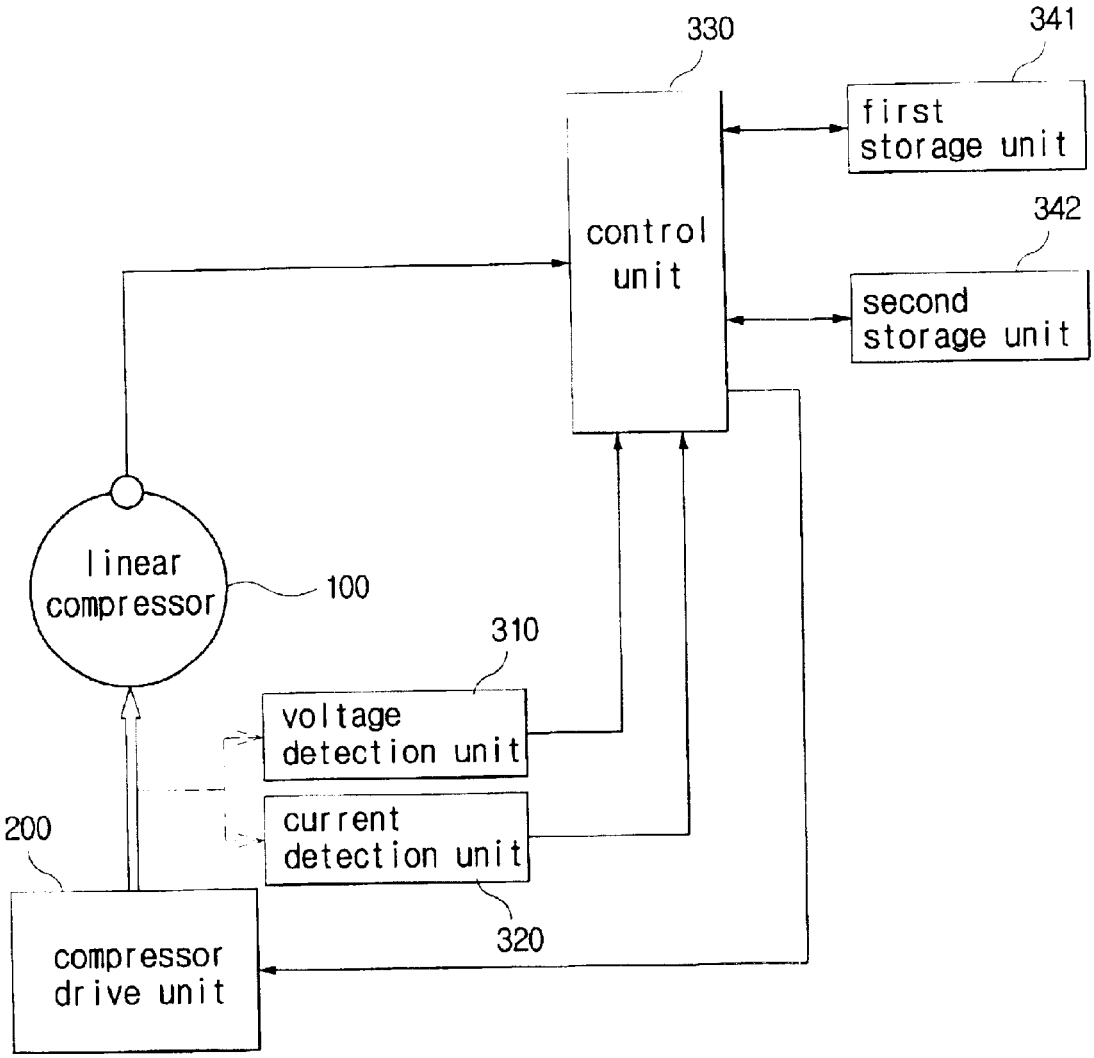
FIG. 3 is a block diagram illustrating an apparatus to control a linear compressor in accordance with an embodiment of the present invention.

FIG. 3 is a block diagram illustrating an apparatus to control a linear compressor in accordance with an embodiment of the present invention.

Referring to FIG. 3, the linear compressor control apparatus of the present invention comprises a control unit 330 and a compressor drive unit 200. The control unit 330 controls the entire operation of the linear compressor 100, while the compressor drive unit 200 operates the linear compressor 100 in response to the control of the control unit 330. The linear compressor control apparatus of the present invention further comprises a first storage unit 341 and a second storage unit 342. The first storage unit 341 stores preset data including preset conduction angle data in response to input voltage, while the second storage unit 342 stores reset data. Additionally, in the linear compressor control apparatus of the present invention, a voltage detection unit 310 and a current detection unit 320 are connected to the control unit 330. The voltage detection unit 310 detects the voltage of the power supplied to the linear compressor 100, while the current detection unit 330 detects the current of the power supplied to the linear compressor 100.

Figure 4:
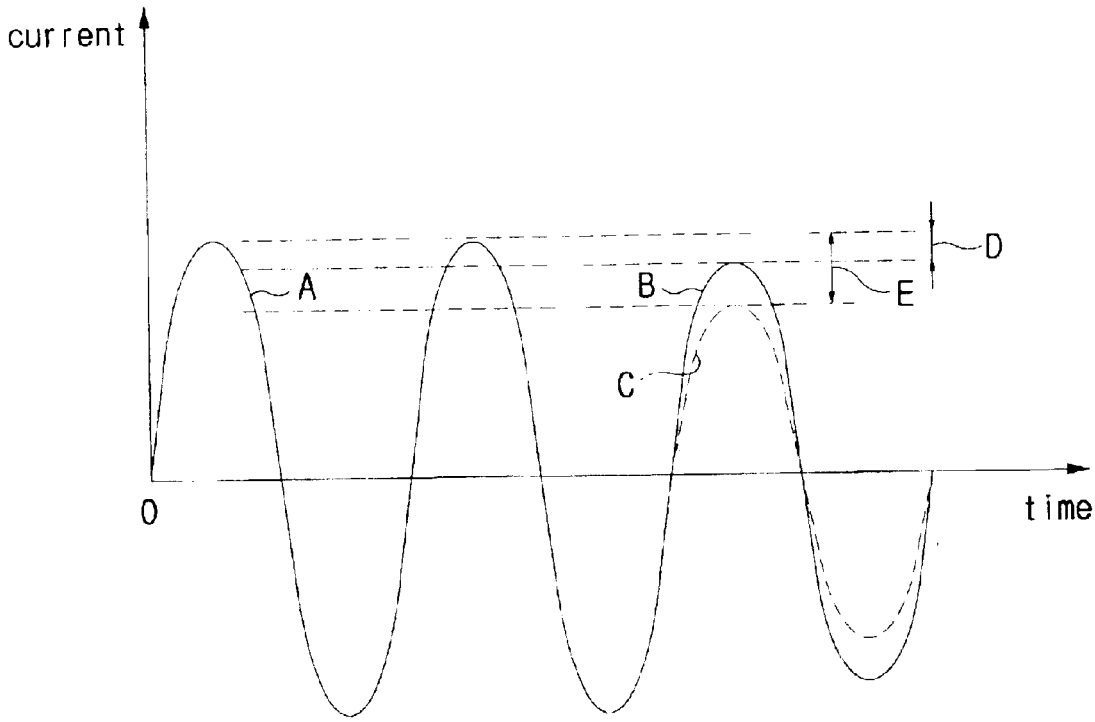
FIG. 4 is a graph illustrating current waveforms in accordance with the operation of the linear compressor.

FIG. 4 is a graph illustrating current waveforms in accordance with the operation of the linear compressor of the present invention. Referring to this figure, "A" represents a reference current waveform. "B" represents a current waveform at a maximum stroke point. "C" represents a current waveform at a collision point. "D" represents a first reference variation that is preset to recognize a maximum stroke. "E" represents a second reference variation that is preset to recognize a collision between the piston and valve of the linear compressor 100. Accordingly, if current is varied by "E", it is recognized that the piston is in collision with the valve.

Figure 5:
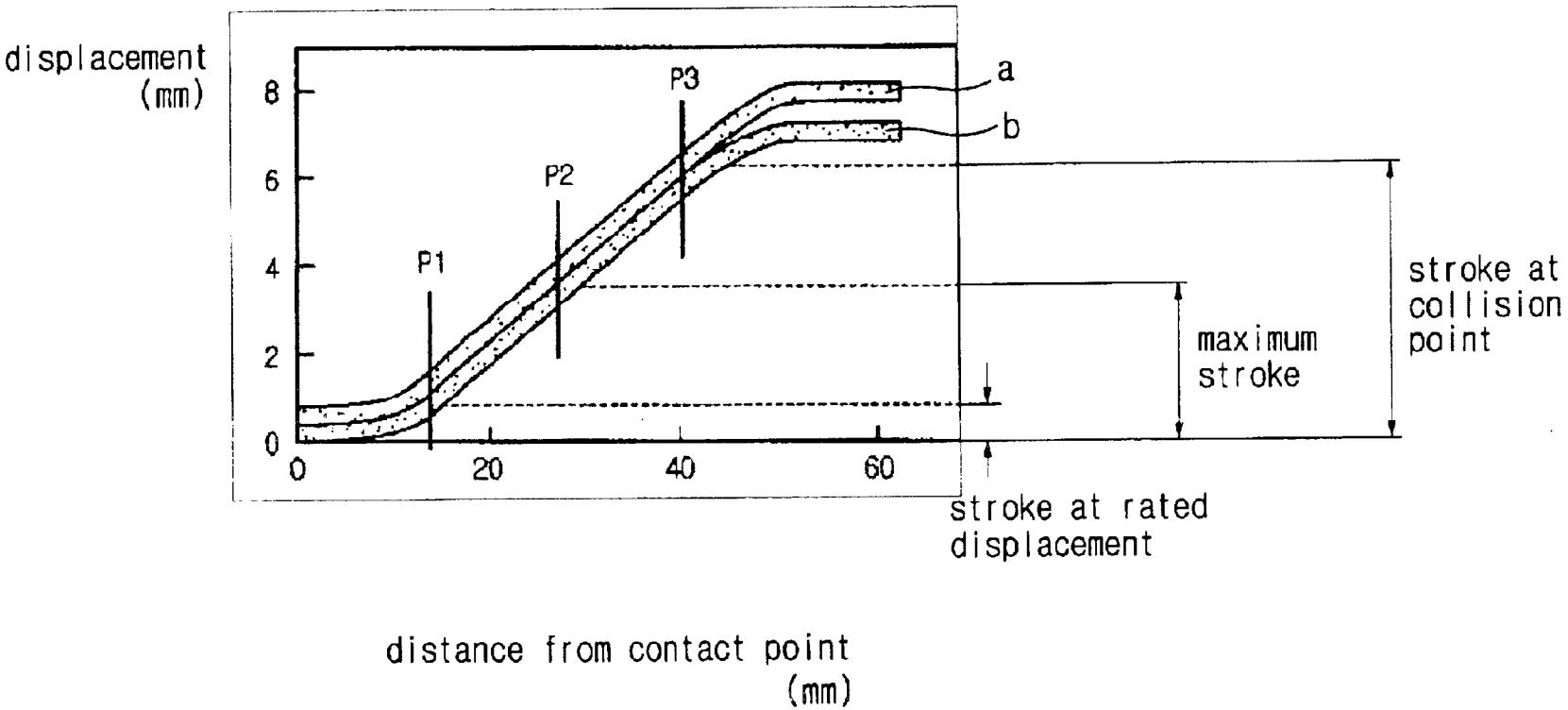
FIG. 5 is a graph illustrating the displacements of a displacement unit and a resonance spring in accordance with the present invention.

FIG. 5 is a graph illustrating the displacements of a displacement restricting unit and a resonance spring (refer to FIG. 1) in accordance with an embodiment of the present invention. In FIG. 5, "a" represents the displacement of the displacement restricting unit, while "b" represents the displacement of the resonance spring. P1 represents a point where the displacement restricting unit and the resonance spring are brought into tight contact with each other at a rated displacement point. P2 represents a point where the displacement restricting unit and the resonance spring are brought into tight contact with each other at a maximum stroke point. P3 represents a point where the displacement restricting unit and the resonance spring are brought into tight contact with each other at a collision point. Referring to FIG. 5, a maximum stroke is greater than a stroke at a rated displacement point, and a stroke at a collision point is greater than the maximum stroke.

Figure 6:
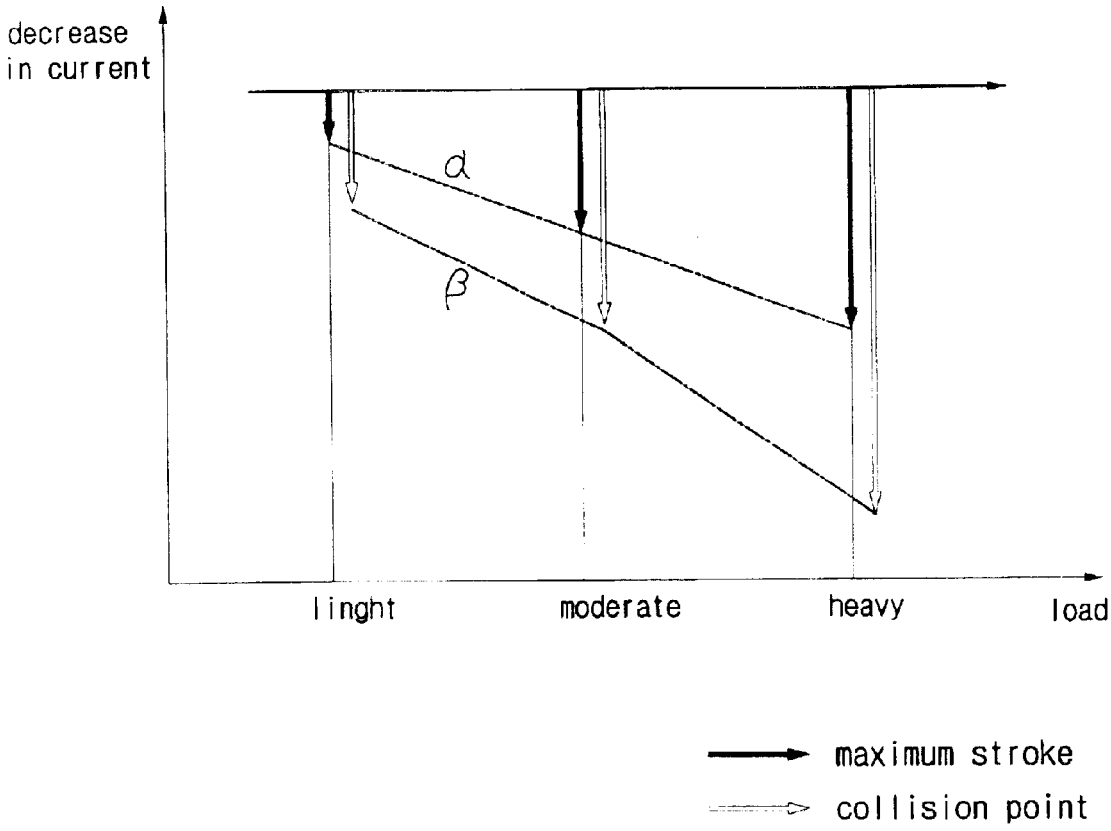
FIG. 6 is a graph illustrating the recognition of a maximum stroke and a collision point using decreases in current.

FIG. 6 is a graph illustrating the recognition of a maximum stroke and a collision point using decreases in current. In this drawing, "$\alpha$" represents the trace of maximum stroke values according to a decrease in current and load, while "$\beta$" represents the trace of collision points according to a decrease in current and load.

A method of controlling the linear compressor in accordance with the present invention is described below.

Figure 7:
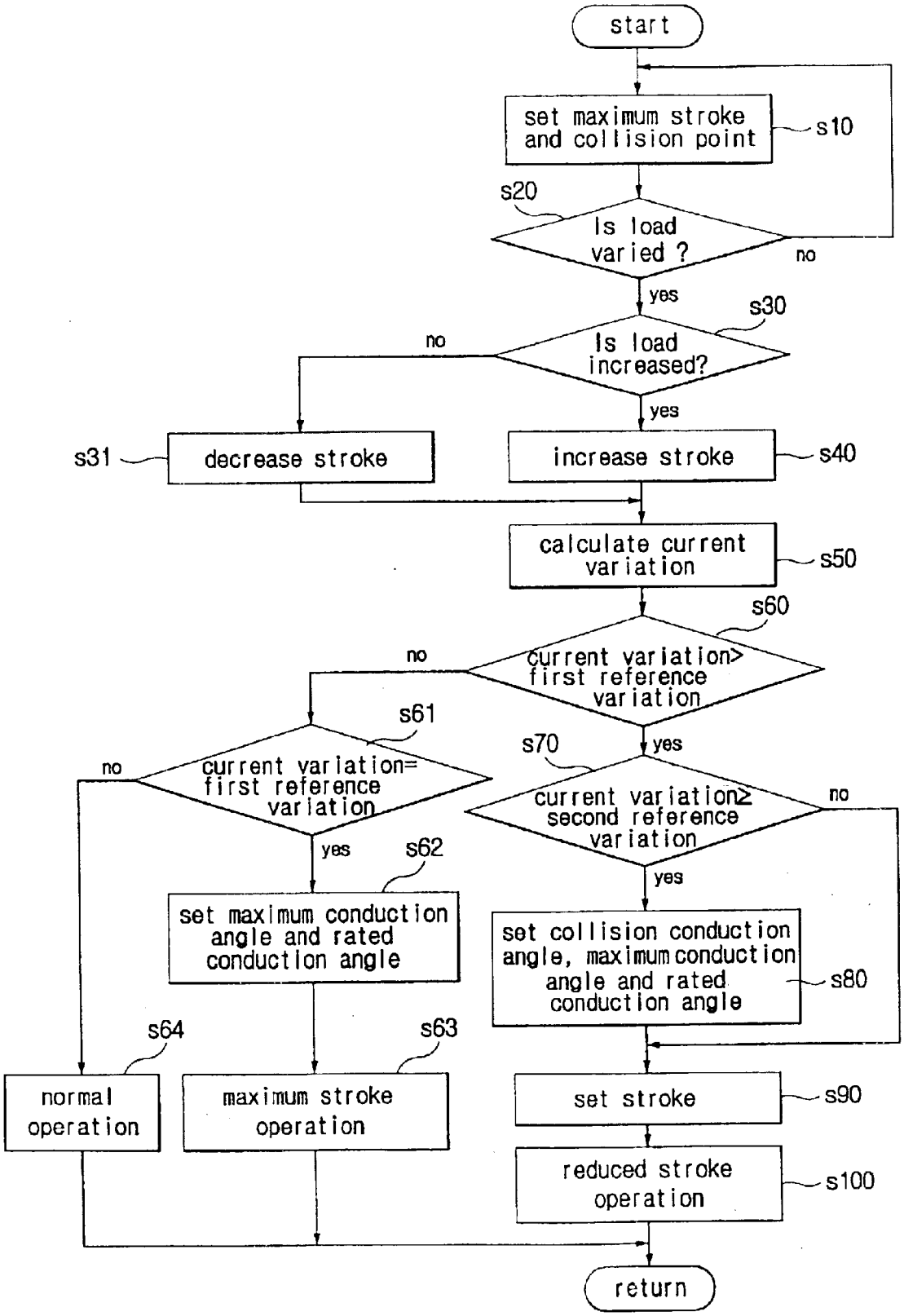
FIG. 7 is a flowchart illustrating a method of controlling the linear compressor in accordance with the present invention.

FIG. 7 is a flowchart illustrating the linear compressor control method of the present invention.

Referring to FIG. 7, the control unit 330 sets a maximum stroke and a collision point of the piston at operation S10. In this case, the amount of load is generally set depending on the opening/closing of a door of a refrigerator, the amount of food in a refrigerator, the set temperature of an interior of a refrigerator, the temperature of outside air, etc.

If the present load is heavy at operation S10, the maximum stroke is set to a first stroke value $\alpha 1$, and the collision point is set to a first collision point $\beta 1$. If the present load is moderate at operation S10, the maximum stroke is set to a second stroke value $\alpha 2$, and the collision point is set to a second collision point $\beta 2$. If the present load is light at operation S10, the maximum stroke is set to a third stroke value $\alpha 3$, and the collision point is set to a third collision point $\beta 3$. These stroke values and collision points are preset to fulfill relations of $\alpha 1<\alpha 2<\alpha 3$, $\beta 1<\beta 2<\beta 3$, $\alpha 1 \leqq \beta 1$, $\alpha 2 \leqq \beta 2$ and $\alpha 3 \leqq \beta 3$.

After the setting of the maximum stroke and the collision point is completed, the control unit 330 determines whether the load is varied at operation S20. In this case, the variation of the load is generally dependent on the opening/closing of a door of a refrigerator, the amount of food in a refrigerator and the set temperature of an interior of a refrigerator. If the load is varied at operation S20, the control unit 330 determines whether the load is increased at operation S30. On the other hand, if the load is not varied at operation S20, the process returns to operation S10.

If the load is increased at operation S30, the control unit 330 controls the compressor drive unit 200 so that the stroke of the piston of the linear compressor 100 is increased at operation S40. On the other hand, if the load is not increased at operation S30, the load is considered as being decreased, so the control unit 330 controls the compressor drive unit 200 to allow the stroke of the piston of the linear compressor 100 to be decreased at step S31.

The control unit 330 detects current supplied to the linear compressor 100 through the current detection unit 320 and calculates a corresponding current variation at operation S50. The control unit 330 determines whether the calculated current variation is greater than a first preset reference variation at operation S60.

If the calculated current variation is greater than the first preset reference variation at operation S60, the control unit 330 determines whether the calculated current variation is equal to or greater than a second preset reference variation at operation S70.

If the calculated current variation is equal to or greater than the second preset reference variation at operation S70, the control unit 330 sets a collision conduction angle, a maximum conduction angle and sets a rated conduction angle at operation S80, thereby recognizing a collision point. Additionally, the control unit 330 sets a decrease in the stroke of the piston of the linear compressor 100 to prevent collisions between the piston and the valve at operation S90, and controls the compressor drive unit 200 so that the linear compressor 100 performs a reduced stroke operation at operation S100. Otherwise, if the calculated current variation is not equal to or greater than the second preset reference variation at operation S70, the control unit 330 sets the stroke of the piston and then reduces the stroke operation.

If the calculated current variation is not greater than the first preset reference variation at operation S60, the control unit 330 determines whether a calculated current variation is equal to the first preset reference variation at operation S61. If the calculated current variation is equal to the first preset reference variation at operation S61, the control unit 330 sets a maximum conduction angle and a rated conduction angle to determine a maximum stroke at operation S62. Accordingly, the control unit 330 controls the compressor drive unit 200 so that the linear compressor 100 performs a maximum stroke operation at operation S63. Thereafter, the process returns to operation S10.

On the other hand, if the calculated current variation is not equal to the first preset reference variation at operation S61, the control unit 330 controls the compressor drive unit 200 so that the linear compressor 100 maintains a current stroke operation (that is, performs a normal operation) at operation S64.

As described above, the present invention provides an apparatus and method of controlling a linear compressor, which is capable of securing a top clearance to correspond to the load without using an additional sensor, thereby minimizing collisions between the piston and the valve and, accordingly, maintaining a highly efficient operation.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An apparatus to control a linear compressor having a piston and a valve, comprising:

a current detection unit to detect a current and a current variation supplied to the linear compressor;

a control unit to set a collision conduction angle, a maximum conduction angle, and a rated conduction angle in accordance with the detected current and the detected current variation to determine whether a collision between the piston and the valve of the linear compressor occurs by using an output signal from the current detection unit, and to control a stroke of the linear compressor; and a compressor drive unit to perform adjustment of the stroke of the linear compressor in response to control of the control unit.

2. The apparatus according to claim 1, wherein the control unit controls a conduction angle of power supplied to the linear compressor by controlling the compressor drive unit according to a current variation detected by the current detection unit.

3. The apparatus according to claim 1, further comprising:

a first storage unit to store preset data including preset conduction angle data in response to input data; and a second storage unit to store reset data.

4. The apparatus according to claim 1, further comprising a voltage detection unit to detect voltage supplied to the linear compressor.

5. A method of controlling a linear compressor in which first and second reference variations are stored, comprising:

presetting a maximum stroke and a collision point according to a load;

increasing and reducing a stroke of the linear compressor according to a variation in the load;

controlling the stroke according to a variation in current supplied to the linear compressor, wherein the controlling comprises:

determining whether the current variation is equal to or greater than the second reference variation if the current variation is greater than the first reference variation, and setting a collision conduction angle, a maximum conduction angle, and a rated conduction angle to recognize a collision point and reducing the stroke of the linear compressor if the current variation is equal to or greater than the second reference variation.

6. The method according to claim 5, wherein the increasing and reducing the stroke is performed to increase the stroke if the load is increased and decrease the stroke if the load is decreased.

7. A method of controlling a linear compressor, comprising:

presetting a maximum stroke and a collision point according to a load;

increasing and reducing a stroke of the linear compressor according to a variation in the load; and controlling the stroke according to a variation in current supplied to the linear compressor, wherein the controlling the stroke comprises:

determining whether the current variation is greater than a preset first reference variation, determining whether the current variation is equal to or greater than a second reference variation if the current variation is greater than the preset first reference variation, setting a collision conduction angle, a maximum conduction angle and a rated conduction angle to recognize a collision point and reducing the stroke of the linear compressor if the current variation is equal to or greater than the preset second reference variation, and reducing the stroke of the linear compressor if the current variation is not equal to or greater than the preset second reference variation.

8. A method of controlling a linear compressor, comprising:

presetting a maximum stroke and a collision point according to a load;

increasing and reducing a stroke of the linear compressor according to a variation in the load; and controlling the stroke according to a variation in current supplied to the linear compressor, wherein the controlling the stroke comprises setting a current stroke of the linear compressor to a maximum stroke if the current variation is equal to a preset first reference variation, and maintaining a current operation of the linear compressor if the current variation is less than the first reference variation.

9. The method according to claim 8, wherein the load is set depending on the opening and/or closing of a door of a refrigerator, an amount of food in the refrigerator, the set temperature of an interior of the refrigerator or the temperature of outside air.

10. A method of controlling a linear compressor, comprising:

presetting a maximum stroke and a collision point according to a load;

increasing and reducing a stroke of the linear compressor according to a variation in the load; and controlling the stroke according to a variation in current supplied to the linear compressor, wherein the controlling the stroke comprises:

determining whether the current variation is greater than a preset first reference variation, determining whether the current variation is equal to a first reference variation if the current variation is not greater than the preset reference variation, setting a maximum conduction angle and rated conduction angle if the current variation is equal to the first reference variation.

11. A linear compressor control apparatus to control a linear compressor having a piston and a valve, comprising:

a compressor drive unit to drive the linear compressor;

a voltage detection unit to detect voltage input to the linear compressor;

a current detection unit to detect current input to the linear compressor;

a control unit to control the compressor drive unit in response to the detected voltage and current; and a first storage unit to store conduction angle data in response to the input voltage to the linear compressor.

12. A linear compressor control apparatus to control a linear compressor having a piston and a valve, comprising:

a compressor drive unit to drive the linear compressor;

a voltage detection unit to detect voltage input to the linear compressor;

a current detection unit to detect current input to the linear compressor;

a control unit to control the compressor drive unit in response to the detected voltage and current; and a first storage unit to store conduction angle data in response to the input voltage to the linear compressor, wherein the control unit sets a maximum stroke and a collision point of the piston such that, if the present load is heavy, the maximum stroke is set to a first stroke value and the collision point is set to a first collision point value, if the load is moderate, the maximum stroke is set to a second stroke value and the collision point is set to a second collision point, and if the present load is light, the maximum stroke is set to a third stroke value and the collision point is set to a third collision point.

13. The linear compressor according to claim 12, wherein the control unit determines whether the load is varied after the maximum stroke and collision points are set to control the stroke of the piston.

14. The linear compressor according to claim 13, wherein the load is set depending on the opening and/or closing of a door of a refrigerator, an amount of food in the refrigerator, the set temperature of an interior of the refrigerator or the temperature of outside air.

15. A method of controlling a linear compressor, comprising:

detecting current and a current variation supplied to the linear compressor;

setting a collision conduction angle, a maximum conduction angle, and a rated conduction angle in accordance with the current and the current variation to determine whether a collision between a piston and a valve on the linear compressor occurs by using the detected current; and adjusting the stroke of the linear compressor if the collision occurs.

16. An apparatus to control a linear compressor having a piston and a valve, comprising:

a current detector to detect a current and a current variation supplied to the linear compressor;

a controller to set a collision conduction angle and a comparable conduction angle in accordance with the current and the current variation to determine, using an output signal form the current detection unit, whether a collision between the piston and the valve of the linear compressor occurs, and to adjust a stroke of the linear compressor.

* * * * *